United States Patent [19]

Nayler et al.

[11] Patent Number: 4,466,488

[45] Date of Patent: Aug. 21, 1984

[54] POSITION INDICATOR FOR DRILL STRING COMPENSATOR

[75] Inventors: Douglas W. J. Nayler; Gerald W. Gilson; Fred C. Tilker; James W. Albert, all of Houston, Tex.

[73] Assignee: NL Industries, Inc., New York, N.Y.

[21] Appl. No.: 322,728

[22] Filed: Nov. 19, 1981

[30] Foreign Application Priority Data

Dec. 22, 1980 [GB] United Kingdom ..... 8041045

[51] Int. Cl.[3] ..... E21B 19/09

[52] U.S. Cl. ..... 166/355; 175/7; 175/27; 175/40

[58] Field of Search ..... 33/DIG. 15; 166/336, 166/355; 175/27, 40, 7, 8

[56] References Cited

U.S. PATENT DOCUMENTS 3,881,695 5/1975 Joubert ..... 175/40
4,121,806 10/1978 Iato et al. ..... 166/35
4,176,722 12/1979 Wetmore et al. ..... 175/7
4,282,939 8/1981 Maus et al. ..... 175/7
4,300,637 11/1981 Valka ..... 166/336

*Primary Examiner*—Stephen J. Novosad
*Assistant Examiner*—William P. Neuder
*Attorney, Agent, or Firm*—Browning, Bushman, Zamecki & Anderson

[57] ABSTRACT

A motion compensator for disposition between an offshore support structure and an offshore well structure movable with respect thereto comprises a compensator assembly interconnected with the support structure and the well structure such that relative movement between said structures will cause movement within the compensator assembly, and a position indicator including a cam assembly for measuring the relative movement within the compensator assembly, and a transducer operatively associated with the cam assembly for translating its measurements into a signal.

22 Claims, 5 Drawing Figures

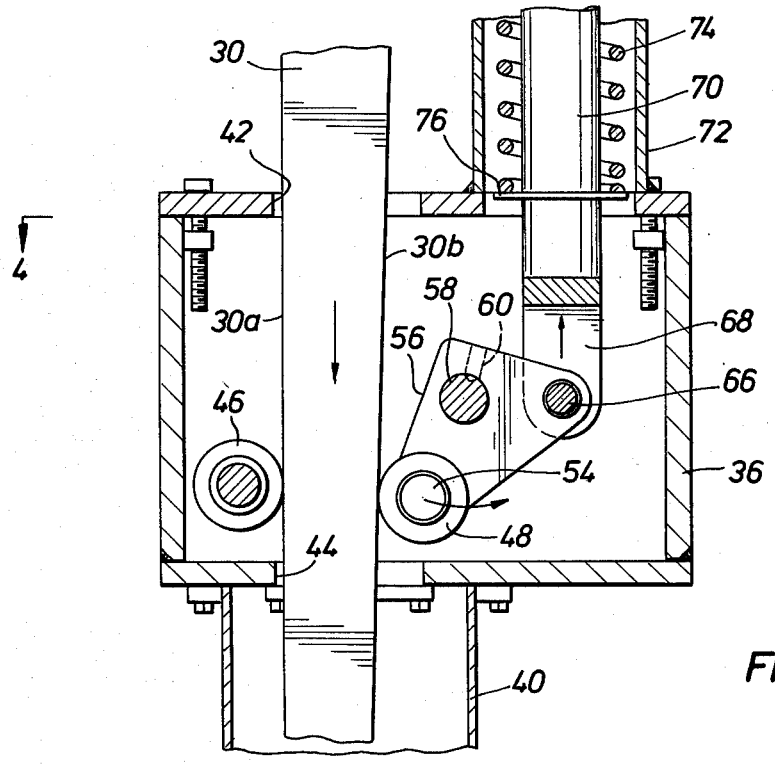
FIG. 3
FIG. 4
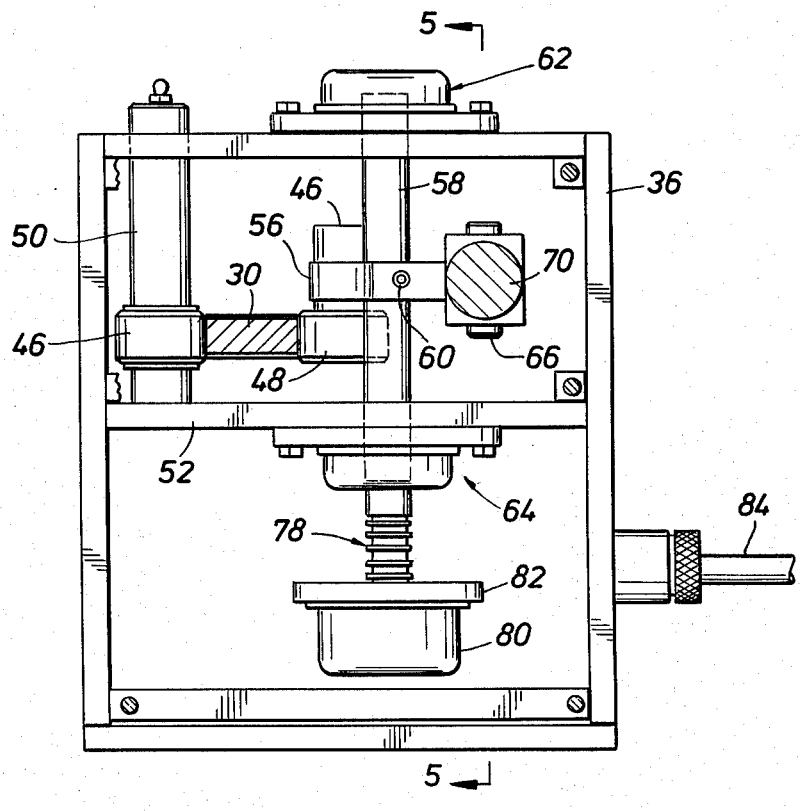

POSITION INDICATOR FOR DRILL STRING COMPENSATOR

BACKGROUND

The present invention relates to instrumentation for use with an apparatus known as a drill string compensator or "D.S.C." Drill string compensators are typically employed on a drilling vessel to compensate for relative vertical movement between such vessel and a drill string being run therefrom caused by heaving of the vessel on the water. For example, a drill string may typically be supported on the traveling block of a block and tackle assembly, and the operator will seek to lower this traveling block at a feed rate corresponding to the penetration rate of the drill bit carried at the lower end of such drill string. However, since the traveling block is in turn carried by the drilling vessel, heaving of the latter can interfere with a proper rate of movement of the drill string. Accordingly, a drill string compensator is preferably interposed between the traveling block and the drill string. For example, a typical compensator includes a pair of parallel piston and cylinder assemblies in which the pistons are supported by compressed air. The drill string may be suspended from the piston rods, while the cylinders are fixed with respect to the drilling vessel and therefore movable therewith. Thus, the piston and cylinder assemblies, in essence, form cushioned telescoping joints which permit the vessel to heave without interfering with the position of, or weight on, the drill string. By controlling the pressure of the air supporting the pistons within their cylinders, such compensators can also be used to control the weight on the drill bit.

As the drill bit penetrates the earth the operator seeks to lower the traveling block at the rate of penetration and also to maintain the pistons in generally centralized positions within their cylinders. To accomplish this, some type of indicator means must be provided to enable the operator to determine, as nearly as possible, the position of the piston within the length of the cylinder as it moves.

One prior indicator subsystem utilized a member, movable with the piston, and having a series of bores therethrough. Means were provided for emitting light so as to shine through these bores as they passed a given point. A counter device having means for detecting light passing through the bores and thereby counting the number of bores which passed the reference point would emit a corresponding signal for the operator. One problem with this system is that it is not as accurate as might be desired, since it can only detect increments of movement and thus does not continuously indicate the exact position of the piston. Another problem associated with this incremental counting system is that it has no permanent memory. Thus, if electrical power is momentarily interrupted, the proper position indication will be lost. It is then necessary to reset the read-out by moving the piston to one extreme end of its stroke. This resetting procedure is extremely troublesome and undesirable.

Other position indicator systems employ a rotary electrical potentiometer connected to a rotatable drum mounted on one of the relatively moving members of the drill string compensator, e.g. the cylinder. A wire is wound on the drum and its free end attached to the other member of the compensator, e.g. the piston rod. As wire is pulled from the drum by the piston rod, the drum is caused to rotate. This operates the potentiometer which emits an electrical signal which may be translated into a read-out value generally indicative of the piston position. A spring is usually employed to rewind the wire as the compensator movement is reversed. Systems of this type are frequently troubled by such problems as breakage of the drive wire and spring failure.

SUMMARY OF THE INVENTION

To overcome the above difficulties and provide a simple yet accurate position indicator for a drill string compensator, the present invention employs a plate cam member having a continuously varying width. The cam member is mounted for movement with the piston rod of the drill string compensator. Opposite sides of the cam are contacted by opposed rollers, one of which is fixed and the other of which is mounted on one arm of a bell crank. The other arm of the bell crank is resiliently biased so as to urge the movable roller into constant contact with its respective side of the cam member and resist backlash or hysteresis. As the cam member moves up and down, portions thereof of differing widths pass between the rollers, moving the movable roller laterally in and out so as to rotate the pivot shaft of the bell crank. This pivot shaft operates an electrical transducer which in turn emits a signal which is ultimately translated into a visual and/or audible reading for the operator. It can be seen that, because of the continuously varying width of the cam and the virtual absence of backlash from the system, a continuous reading is provided which indicates the precise position of the piston attached to the cam member.

BRIEF DESCRIPTION OF THE DRAWINGS

FIG. 3 is an enlarged partial sectional, partial elevational view of the position indicator.

FIG. 4 is a partial sectional, partial elevational view of the position indicator taken along the line 4—4 in FIG. 3.

DETAILED DESCRIPTION

Figure 2:
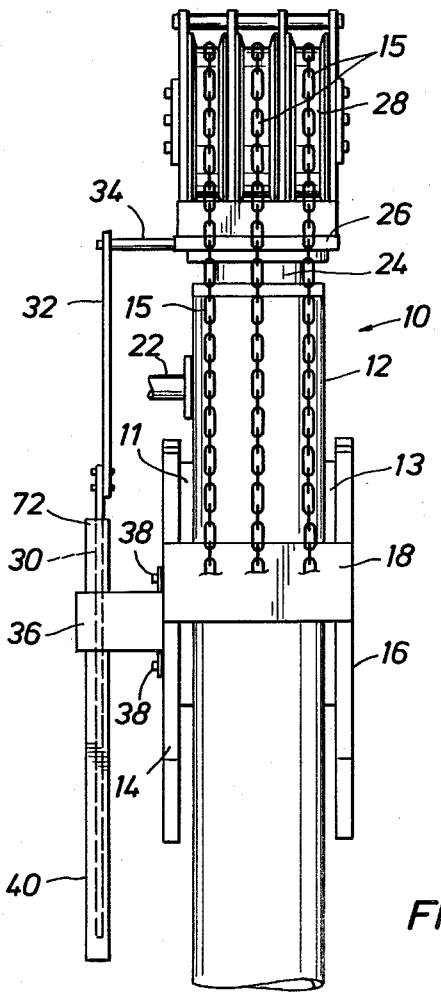
FIG. 2 is a side elevational view of the apparatus of FIG. 1 taken along the line 2—2 in FIG. 1.
Figure 1:
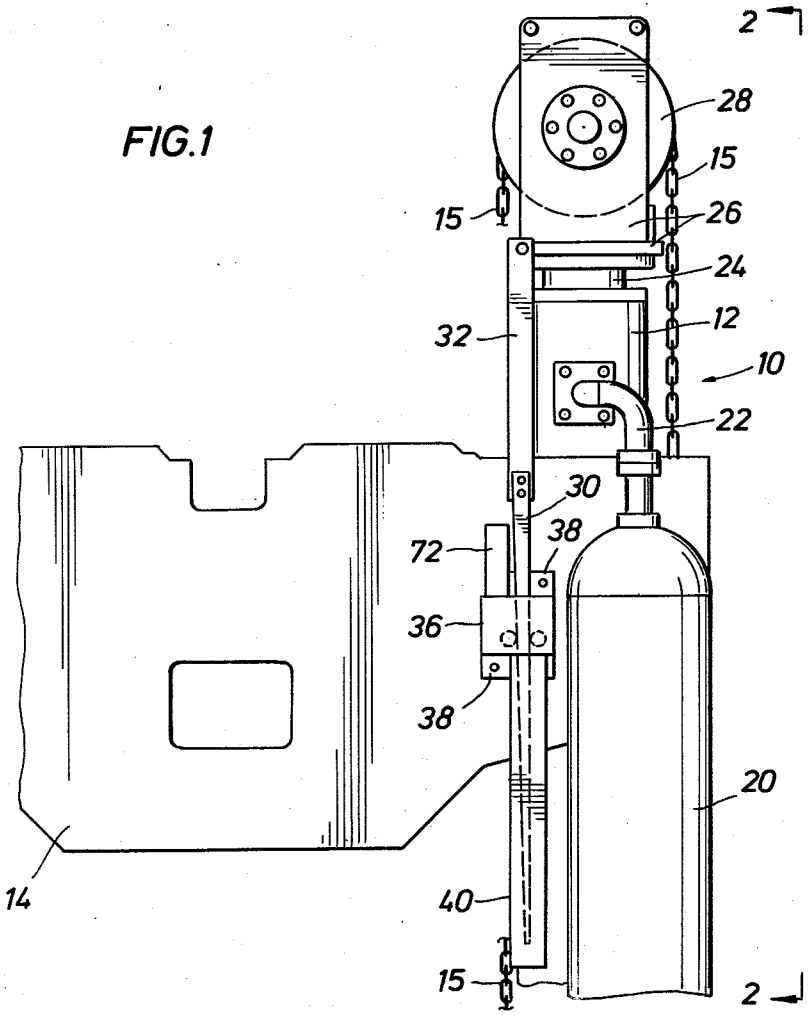
FIG. 1 is a front elevational view of a drill string compensator with a position indicator according to the present invention, along with related apparatus.

Referring to FIGS. 1 and 2, there is shown a drill string compensator comprising a generally vertical piston and cylinder assembly 10. The cylinder 12 of assembly 10 is rigidly affixed to a supporting framework including parallel plates 14 and 16 and connecting struts such as the one shown at 18. More specifically, cylinder 12 is mounted between plates 14 and 16 by mounting blocks 11 and 13. The piston rod 24 of assembly 10 extends outwardly from the upper end of cylinder 12 and has mounted on its free end a bracket structure 26, which in turn rotatably mounts a sheave 28. Chains 15 each have one end fixed to strut 18, so that they are effectively fixed to cylinder 12, and pass from strut 18 upwardly over sheave 28 and then back down to a structure known as a "hook frame" (not shown) from which the drill string is suspended. While assembly 10 and its sheave 28 are disposed generally at one side of parallel plates 14 and 16, an identical piston, cylinder, sheave and chain combination would be disposed at the other side of the plates, the chains of the two such assemblies jointly supporting the aforementioned hook frame. Thus, it should be understood that the following description of the operation of assembly 10 applies equally well to the parallel assembly which would make up the other half of the drill string compensator.

As mentioned, the hook frame (not shown), and thus the drill string, is supported on chain 15, and thus on the piston of assembly 10. Said piston is in turn supported within cylinder 12 by compressed air which is supplied to the lower half of cylinder 12 by means well known in the art. The supporting framework 14, 16, 18, etc., and thus the attached cylinder 12, is mounted on a traveling block, which in turn is carried by the drilling vessel. Accordingly, cylinder 12 will move upwardly and downwardly with the heave of the vessel. However, assembly 10 in effect provides a cushioned telescoping joint between the heaving vessel and attached parts, on the one hand, and the drill string, on the other, so that such heaving motion is not transmitted to the drill string. The upper portion of cylinder 12 above the piston is filled with a buffer fluid, such as oil. If the cylinder moves downwardly, so that the movement of the piston relative thereto is upwardly, the oil thus displaced may pass into an overflow vessel 20 through a line 22. Vessel 20 is suitably pressurized so that, when the direction of relative movement between the piston and cylinder is reversed, oil will flow back into the upper portion of the cylinder.

It can be seen that, by adjusting the pressure of the air in the lower portion of cylinder 12, the operator can control the weight on the drill bit which is ultimately supported by chains 15. However, as additional sections of drill pipe are added to the drill string thereby increasing its weight, the air pressure must also be adjusted. The operator will seek to position the traveling block so that, were there no vessel heave, the piston would be located at the mid point of its stroke within cylinder 12. Then, when the vessel does heave, the compensator will in fact accommodate the amount of travel for which it is designed without danger of the piston striking the ends of cylinder 12. To accomplish this purpose, a position indicator is provided by which the operator can determine the actual position of the piston within cylinder 12 at any given time. As mentioned, the complete compensator actually includes two parallel piston and cylinder assemblies. However, because these assemblies move in unison, it is only necessary to provide a single position indicator, in this case, the one shown associated with assembly 10.

The position indicator generally comprises two subsystems which are respectively connected to the two relatively movable parts of the compensator, i.e. the piston and cylinder. The subsystem which is connected to the piston comprises a plate cam 30. Cam 30 is elongated parallel to the axis of the compensator 10 and has a continuously varying width for a purpose to be more fully described below. The length of cam 30 is slightly greater than the stroke of assembly 10. Cam 30 is disposed with its wide end uppermost, said upper end being rigidly connected to bracket 26 by vertical and horizontal link pieces 32 and 34 respectively. As previously mentioned, bracket 26 is mounted on the upper end of piston rod 24. Thus, cam 30 will move vertically along with the piston of assembly 10. (For purposes of this description, relative movement between the piston and cylinder of assembly 10 may, for convenience, be referred to as movement of the piston, although it will be realized that the cylinder may actually move with the heaving of the vessel.)

The second subsystem of the position indicator includes a number of parts mounted on or in a housing 36. Housing 36 has flanges 38 which are screwed to plate 14, and thus, ultimately connected to the cylinder 12 of the drill string compensator. Cam 30 passes through housing 36, its lower or free end extending into a housing extension or pocket 40 to protect it from damage. As the piston rod 24 of the drill string compensator reciprocates, cam 30 will move vertically with respect to housing 36 and the related parts (described below), the latter remaining fixed with respect to cylinder 12.

Figure 5:
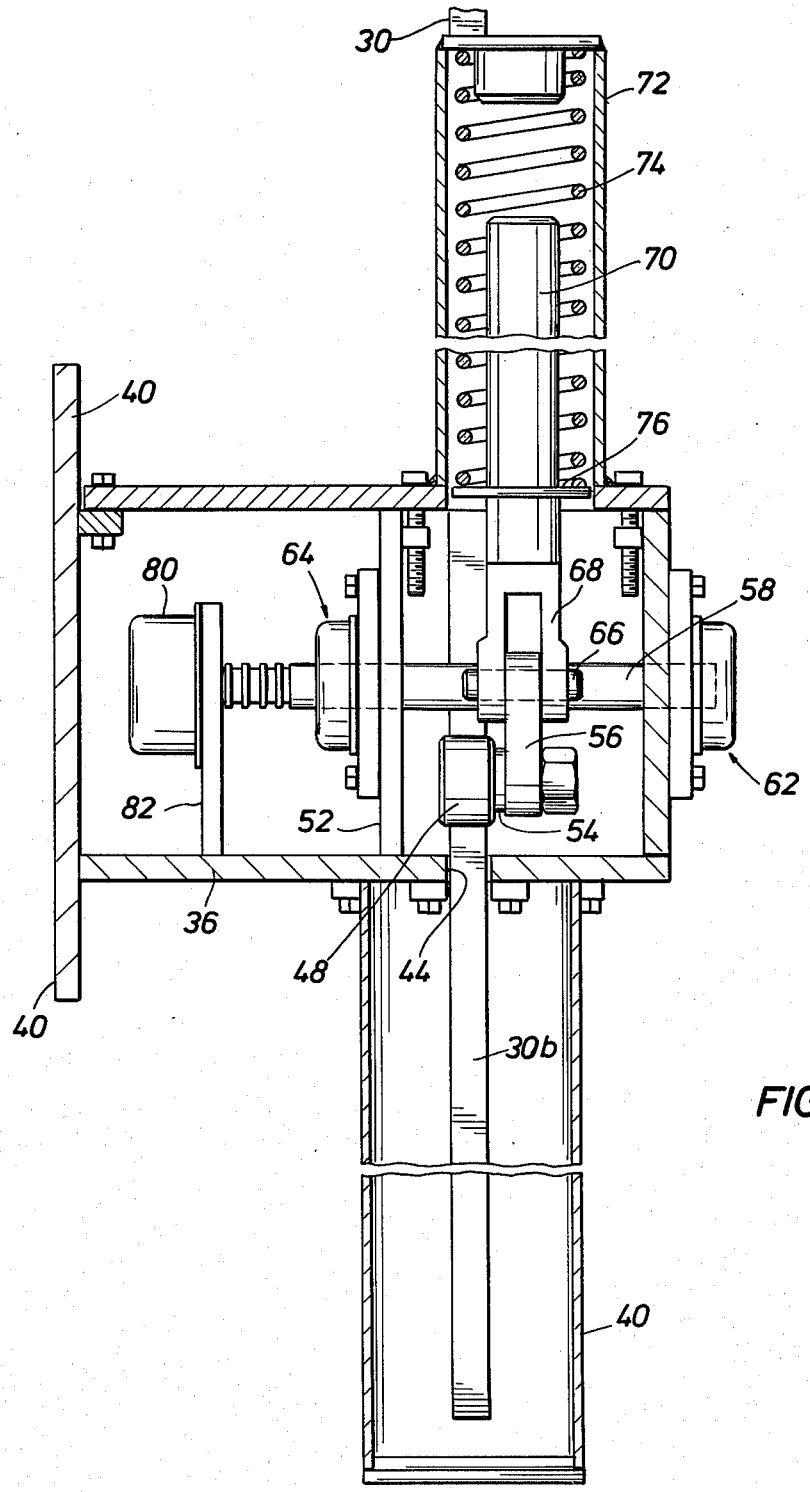
FIG. 5 is a partial sectional, partial elevational view of the position indicator taken along the line 5—5 in FIG. 3.

Referring now to FIGS. 3–5, the position indicator is shown in greater detail. Cam 30 has opposite side surfaces **30*a* and 30*b*, surface 30*a* being a straight vertical surface, and surface 30*b* being a continuously inclined or tapered surface. Cam 30 passes through an opening 42 in the upper wall of housing 36 and an opening 44 in the lower wall of housing 36, opening 44 in turn communicating with pocket 40. The width of openings 42 and 44, as shown in FIG. 3, is oversized with respect to cam 30. However, as seen in FIG. 5, the depth of opening 44 is fairly closely sized with respect to that of cam 30 so as to prevent lateral play of cam 30 in the plane of FIG. 5. The depth of opening 42 is similar. Lateral play in the plane of FIG. 3 is prevented by the fact that cam 30 is clamped between a pair of rollers 46 and 48**.

Roller 46 is rotatably mounted on a fixed shaft 50, respective ends of which are mounted in one of the side walls of housing 36 and a partition wall 52 located within the housing. Roller 46 contacts straight side **30*a* of cam 30. Roller 48 contacts tapered side 30*b* of cam 30 and is rotatably mounted on a movable shaft 54, which in turn is mounted on one arm of a bell crank 56. Bell crank 56 is fixed to its pivot shaft 58 by a set screw 60. The ends of shaft 58 are rotatably mounted generally in the same housing walls as the ends of shaft 50, and more specifically, by lubricated bearing structures 62 and 64. Since shaft 58 is rotatably mounted in housing 36, which in turn is fixed to cylinder 12 by members 14 and 11, shaft 58 is effectively rotatably connected to the exterior of cylinder 12. Further, since roller 48 is mounted on crank 56, which in turn is mounted on shaft 58, roller 48 and crank 56 are effectively carried on cylinder 12 by virtue of the aforementioned connection between shaft 58 and cylinder 12. The other arm of bell crank 56 is pivotally connected by a rotatable pin 66 to a clevis 68 on the lower end of a vertical push rod 70. The end of rod 70 opposite clevis 68 extends upwardly into a pocket-like extension 72 of housing 36. A compression spring 74 bears against the upper end wall of pocket 72 and against a radial flange 76 on rod 70. This urges rod 70 downwardly, which in turn tends to pivot bell crank 56 and its shaft 58 in a clockwise direction as viewed in FIG. 3 to urge roller 48 tightly against side surface 30*b* of cam 30. Spring 74 is preferably a heavy spring, e.g. capable of imparting a force, in the order of one hundred fifty pounds, to bell crank 56. This provides a firm clamping action of roller 48 against cam 30** and helps to prevent backlash or hysteresis in the system.

As cam 30 moves upwardly and downwardly with the piston of the drill string compensator, portions of the cam of differing widths will pass between the opposed rollers 46 and 48. This will move the latter roller toward and away from the former, such movement being permitted by rotation of bell crank 56 and its shaft 58. Shaft 58 extends through housing partition wall 52 and bearing structure 64 into that compartment of housing 36 on the opposite side of partition 52 from the cam, rollers, bell crank, etc. There the end of shaft 58 is connected, by a zero backlash instrument type flexible coupling 78, coaxially to the shaft of an electrical precision transducer 80 mounted on a support plate 82 rigidly affixed to the lower wall of housing 36.

Transducer 80 produces an electrical signal which is a function of the rotational position of its shaft, and thus, of shaft 58. The rotational position of shaft 58 is in turn a function of the width of the portion of the cam 30 currently located between rollers 46 and 48, that width in turn being proportional to the longitudinal position of the piston of the drill string compensator. Because the width of cam 30 is continuously varied, the signal produced by transducer 80 will be accurately and continuously indicative of the position of the compensator piston. Error in the signal of transducer 80 is further eliminated by coupling 78 and heavy compression spring 74, which together prevent backlash or hysteresis. The signal of transducer 80 is communicated, by means not shown, to an electrical conduit 84, which is connected to electrical apparatus which translates the signal into a visual and/or audible form usable by the operator.

More specifically, the electrical portions of the system, (not all of which are shown) may include a linearizer connected to transducer 80 for compensating the transducer's output to make it produce a linear signal for a signal conditioner. The signal conditioner in turn would amplify and zero reference the electrical signal. A visual display could then be produced from such modified signal by a suitable read-out device. The system could also include warning circuits which would produce an alarm when the compensator piston approaches the ends of its cylinder to further insure that the piston will not be permitted to strike the ends of the cylinder.

While the above represents only one preferred embodiment of the invention, numerous modifications can be made within the spirit of the invention. For example, the above position indicator has been illustrated and described in association with a type of motion compensator known as a "drill string compensator." However, the position indicator and/or modifications thereof could also be used with other types of motion compensators, such as riser tensioners, all of which compensate for relative movement between some type of well structure, such as a drill string or a string of riser pipes, on the one hand, and some type of support structure, such as a drilling vessel, on the other hand. Numerous other modifications will suggest themselves to those of skill in the art. Accordingly, it is intended that the present invention be limited only by the claims which follow.

We claim:

1. Motion compensation apparatus for disposition between an offshore support structure and an offshore well structure movable with respect to said support structure, comprising:

first and second compensator bodies interconnected with said support structure and said well structure, and further interconnected with each other, such that relative movement between said structures causes relative movement between said compensator bodies;

and position indicator means associated with said bodies comprising first and second indicator members carried respectively by said first and second compensator bodies whereby said relative movement of said compensator bodies causes relative movement of said indicator members in a first directional mode;

said first indicator member being elongated in said first directional mode and having a transverse dimension which varies along its length;

said second indicator member being laterally engagable with said first indicator member and further being laterally movable with respect to said first indicator member;

and means operably associated with said second indicator member for producing a signal varying with the lateral movements of said second indicator member.

2. The apparatus of claim 1 wherein said signal-producing means comprises transducer means, and said signal is electrical.

3. The apparatus of claim 1 wherein said first indicator member is a plate cam having one lateral surface extending generally parallel to said first diretional mode of movement and another lateral surface, opposite said one surface, which is inclined with respect to said one surface; and wherein said second indicator member engages said other lateral surface of said first indicator member.

4. The apparatus of claim 3 wherein said second indicator member comprises a crank member mounted for pivotal movement with respect to said second compensator body, and having one arm so engagable with said other lateral surface and movable toward and away from said one lateral surface by said pivotal connection.

5. The apparatus of claim 4 wherein said crank further comprises another arm disposed angularly with respect to said one arm, said indicator means further comprising means connected with said other arm of said crank for biasing said one arm of said crank against said other lateral surface of said first indicator member.

6. The apparatus of claim 4 wherein said crank is mounted on a pivot shaft for joint rotation therewith, said shaft being operatively connected to said signal producing means.

7. The apparatus of claim 3 wherein said compensator bodies are telescopically connected for relative movement generally in said first directional mode, and wherein the length of said plate cam member is greater than the stroke of said compensator bodies.

8. A motion compensation apparatus for disposition between an offshore support structure and an offshore well structure movable with respect to said support structure, comprising:

a compensator assembly interconnected with said support structure and said well structure such that relative movement between said structures causes movement within said compensator assembly;

means associated with said compensator assembly for resiliently resisting said movement within said compensator assembly;

and position indicator means associated with said compensator assembly comprising a cam assembly for measuring the relative movement within said compensator assembly;

transducer means operably associated with said cam assembly for translating the measurement of said cam assembly into a signal.

9. The apparatus of claim 8 wherein said compensator assembly comprises:

a generally vertical cylinder connected to one of said structures;

a piston within said cylinder and carrying a piston rod extending from said cylinder and connected to the other of said structures.

10. The apparatus of claim 9 wherein said support structure is a drilling vessel and said well structure is a drill string.

11. The apparatus of claim 9 wherein said cam assembly comprises:

a plate cam member rigidly connected to said piston rod so as to reciprocate with the movement of said piston relative to said cylinder;

a pivot shaft rotatably connected to the exterior of said cylinder and operatively connected to said transducer means;

a follower rigidly attached to said pivot shaft and engageable with said plate cam member for rotation upon reciprocation of said plate cam member.

12. The apparatus as defined in claim 11, wherein said plate cam member is of continuously varying width.

13. The apparatus as defined in claim 12, wherein said plate cam member is elongated generally parallel to the axis of said piston rod.

14. The apparatus as defined in claim 13, wherein said plate cam member is disposed with its wide end uppermost.

15. The apparatus as defined in claim 13, wherein said plate cam member has differing side surfaces, one of said side surfaces being generally parallel to said axis of said piston rod, and other of said side surfaces being a continuously tapered surface.

16. The apparatus of claim 15 wherein said follower comprises a crank member one arm of which includes a roller abutting said other side surface of said plate cam member.

17. The apparatus as defined in claim 16 further comprising an idler roller abutting said one side of said plate cam member.

18. An apparatus as defined in claim 11, wherein said pivot shaft is mounted horizontally in relation to said plate cam member.

19. An apparatus as defined in claim 11, wherein said follower is urged toward said plate cam member through a push rod assembly.

20. The apparatus as defined in claim 19, wherein said push rod assembly comprises a push rod, a compression spring bearing against said push rod, and a connection means between said push rod and said follower.

21. The apparatus as defined in claim 20, wherein said connection means comprises a clevis.

22. An apparatus as defined in claim 11, wherein said transducer is connected coaxially to said pivot shaft through a flexible coupling.

* * * * *